US008677950B2

(12) United States Patent
Hofbauer

(10) Patent No.: US 8,677,950 B2
(45) Date of Patent: Mar. 25, 2014

(54) COMBUSTION CHAMBER PROMOTING TUMBLE FLOW

(75) Inventor: Peter Hofbauer, West Bloomfield, MI (US)

(73) Assignee: EcoMotors, Inc., Allen Park, MI (US)

( * ) Notice: Subject to any disclaimer, the term of this patent is extended or adjusted under 35 U.S.C. 154(b) by 0 days.

(21) Appl. No.: 13/551,063

(22) Filed: Jul. 17, 2012

(65) Prior Publication Data

US 2013/0025556 A1 Jan. 31, 2013

Related U.S. Application Data

(60) Provisional application No. 61/511,583, filed on Jul. 26, 2011, provisional application No. 61/523,360, filed on Aug. 14, 2011.

(51) Int. Cl.
*F01C 9/00* (2006.01)

(52) U.S. Cl.
USPC ..... 123/51 R; 123/51 AC; 123/51 BC; 123/306; 123/661; 92/172

(58) Field of Classification Search
USPC ..... 123/51 AC, 51 BC, 306, 307, 661, 123/197.2, 193.1, 193.6, 51 R; 92/172
See application file for complete search history.

(56) References Cited

U.S. PATENT DOCUMENTS

| | | | | |
|---|---|---|---|---|
| 1,486,583 | A * | 3/1924 | Huskisson | 123/51 B |
| 1,523,453 | A | 1/1925 | Scott | |
| 2,256,776 | A * | 9/1941 | Kammer | 123/256 |
| 2,396,429 | A * | 3/1946 | Krygsman | 123/51 B |
| 3,923,019 | A * | 12/1975 | Yamada | 123/51 BA |
| 4,090,479 | A * | 5/1978 | Kaye | 123/306 |
| 4,841,928 | A * | 6/1989 | Paul et al. | 123/193.4 |
| 5,042,441 | A * | 8/1991 | Paul et al. | 123/276 |
| 6,170,443 | B1 * | 1/2001 | Hofbauer | 123/51 B |
| 6,182,619 | B1 * | 2/2001 | Spitzer et al. | 123/51 B |
| 2008/0115771 | A1 | 5/2008 | Elsbett | |
| 2011/0271932 | A1 * | 11/2011 | Fuqua et al. | 123/301 |
| 2012/0073541 | A1 * | 3/2012 | Fuqua et al. | 123/301 |

FOREIGN PATENT DOCUMENTS

| | | |
|---|---|---|
| BE | 388676 | 6/1932 |
| FR | 50349 | 3/1940 |
| GB | 531366 | 1/1941 |
| SU | 1216394 | 7/1986 |
| WO | 2009061873 | 5/2009 |

* cited by examiner

*Primary Examiner* — Noah Kamen
*Assistant Examiner* — Grant Moubry
(74) *Attorney, Agent, or Firm* — Diana D. Brehob

(57) ABSTRACT

A combustion chamber in an opposed-piston, internal-combustion engine is disclosed in which the pistons tops are designed so that when they approach each other, they induce a tumble flow in one or two hemispherical spaces defined in the piston tops. The combustion chamber further includes injectors side mounted in the cylinder wall. In one embodiment, the tumble flows in the two hemispheres are in the same direction and in another embodiment, in opposite directions. In yet another embodiment, there is only one injector and one hemisphere in which a tumble flow is induced.

16 Claims, 7 Drawing Sheets

COMBUSTION CHAMBER PROMOTING TUMBLE FLOW

CROSS REFERENCE TO RELATED APPLICATIONS

The present application claims priority benefit from U.S. provisional patent applications 61/511,583 filed 26 Jul. 2011 and 61/523,360 filed 14 Aug. 2011.

FIELD

The present disclosure relates to shape of the combustion chamber and injector orientation in internal combustion engines.

BACKGROUND

Thermal efficiency and engine-out emissions from an internal combustion engine are determined by many factors including the combustion chamber shape, the fuel injection nozzle, fuel injection pressure, to name a few. Much is known and much has been studied in typical diesel engine combustion chambers. However, in unconventional engines, less is known about what combustion chamber shape and fuel injection characteristics can provide the desired performance.

Such an unconventional engine, an opposed-piston, opposed-cylinder (OPOC) engine 10, is shown isometrically in FIG. 1. An intake piston 12 and an exhaust piston 14 reciprocate within each of first and second cylinders (cylinders not shown to facilitate viewing pistons). An intake piston 12' and an exhaust piston 14 couple to a journal (not visible) of crankshaft 20 via pushrods 16. An intake piston 12 and exhaust piston 14' couple to two journals (not visible) of crankshaft 20 via pullrods 18. The engine in FIG. 1 has two combustion chambers formed between a piston top 22 of intake piston 12 (or 12') and a piston top 24 of exhaust piston 14 (or 14') and the cylinder wall (not shown). The pistons in both cylinders are shown at an intermediate position in FIG. 1. Combustion is initiated when the pistons are proximate each other. The piston tops 22 and 24 in FIG. 1 may not be optimized to provide the desired performance. The piston top 24 has a raised region at the periphery and a flat bowl in the middle of the chamber. To achieve a desired compression ratio, the volume contained in the piston bowls is prescribed. Piston top 24 has a raised region, known by one skilled in the art as squish. The projected area of the squish region is a small portion of the projected area of piston top 24, whereas the bowl is the greater portion of the projected area. Because of the large area taken up by the bowl, the depth of the bowl is limited. Such a shallow bowl allows little space to accommodate fuel jets from an injector to enter the combustion chamber without significantly impinging on piston top surfaces.

SUMMARY

A combustion chamber that induces tumble flow is disclosed. The combustion chamber includes a cylinder wall; an intake piston disposed within the cylinder wall; an exhaust piston disposed within the cylinder wall; and a first fuel injector disposed in an opening that pierces the cylinder wall. The pistons are adapted to reciprocate within the cylinder walls. When tops of the pistons are at their closest approach, the combustion chamber located between the tops of the piston forms first and second regions: the first region being substantially a cone proximate the injector with a tip of the cone closer to the first injector and a base of the cone away from the first injector and the second region being substantially a hemisphere with a flat surface of the hemisphere substantially coincident with a base of the cone. The pistons are configured to reciprocate between an upper and a lower position and the cone provides a line-of-sight opening between a tip of the first injector and the hemisphere. A cross section of the pistons taken through a central axis of the cylinder which is 90 degrees rotated from intersecting the injector toward the hemisphere of the combustion chamber shows the tops of the two pistons on each side of the hemispherical region of the combustion chamber sloped so that a thin ribbon that exists between the two piston tops when the pistons are at their closest approach is substantially tangent to a periphery of the hemisphere. When the pistons approach each other, gases between the two pistons are squeezed into the conical and hemispherical region inducing a vortex. The vortex is a tumble flow with an axis of rotation of tumble flow is substantially perpendicular to a central axis of the cylinder wall. A cross section of the pistons coincident with the base of the cone shows the tops of the two pistons on each side of the hemisphere is sloped so that thin ribbons that exist between the two piston tops when the pistons are at their closest approach are substantially tangent to a periphery of the hemisphere.

Some embodiments include a second fuel injector disposed in a second opening that pierces the cylinder wall. The second fuel injector is in an opposed arrangement with respect to the first injector. When tops of the pistons are at their closest approach, the combustion chamber located between the tops of the piston also forms third and fourth regions: the third region being substantially a cone proximate the second injector with a tip of the cone closer to the second injector and a base of the cone away from the second injector and the fourth region being substantially a hemisphere with a flat surface of the hemisphere of the fourth region coincident with a base of the cone of the third region. The hemisphere of the fourth region and the hemisphere of the second region do not overlap. A cross section of the pistons coincident with the base of the cone of the first region shows the tops of the two pistons on each side of the hemisphere of the second region sloped so that thin ribbons that exist between the two piston tops when the pistons are at their closest approach are substantially tangent to a periphery of the hemisphere of the second region and a cross section of the pistons coincident with the base of the cone of the third region shows the tops of the two pistons on each side of the hemisphere of the fourth region sloped so that thin ribbons that exist between the two piston tops when the pistons are at their closest approach are substantially tangent to a periphery of the hemisphere of the fourth region. When the pistons approach each other, gases between the two pistons that are squeezed out into the hemispherical region of the second region generate a tumble flow in a first direction. When the pistons approach each other, gases between the two pistons that are squeezed out into the hemispherical region of the fourth region also generate a tumble flow substantially in the first direction. In an alternative embodiment, when the pistons approach each other, gases between the two pistons that are squeezed out into the hemispherical region of the fourth region generate a tumble flow in a direction having an opposite sense as the first direction.

A combustion chamber is disclosed having a cylinder wall; an intake piston disposed within the cylinder wall; an exhaust piston disposed within the cylinder wall; and first and second fuel injectors disposed in first and second openings that pierce the cylinder wall with the first and second injectors substantially opposed to each other. The pistons are adapted to reciprocate within the cylinder walls. When tops of the pistons are at their closest approach, the combustion chamber located between the tops of the piston defines a first cone with a tip of the cone substantially coincident with a tip of the first injector and a base of the cone located away from the first injector; a second cone with a tip of the second cone coincident with a tip of the second injector and a base of the cone located away from the second injector; a first hemisphere with a base of the first hemisphere coincident with a base of the first cone; and a second hemisphere with a base of the second hemisphere coincident with a base of the second cone. When tops of the pistons are at their closest approach, the first and second cones and the first and second hemispheres are arranged substantially along a diameter defined by tips of the first and second injectors and the first and second hemispheres do not intersect. When the pistons approach each other, gases between the tops of the pistons other than between the first and second cones and the first and second hemispheres are squeezed into the first and second cones and the first and second hemispheres; and the piston tops are arranged so that the gases squeezed into the first and second hemispheres generates tumble flows. The intake piston has a raised portion on one side of the a plane intersecting tips of the first and second injectors and parallel to a central axis of the cylinder; the exhaust piston has a corresponding recessed portion on one side of the plane; the intake piston has a recessed portion on the other side of the plane; and the exhaust piston has a corresponding raised portion on the other side of the plane. The tumble flow in the first hemisphere rotates in substantially the same direction as the tumble flow in the second hemisphere. Considering first, second, third, and fourth quadrants of the piston tops, the intake piston has raised portions in the first and third quadrants, the intake piston has recessed portions in the second and fourth quadrants, the exhaust piston has recessed portions in the first and third quadrants, and the exhaust piston has raised portions in the second and fourth quadrants. The raised and recessed portions are exclusive of the cones and hemispheres defined in the piston tops. The second quadrant is located between the first and third quadrants. The raised portions of the piston tops index with the recessed portions of the piston tops to develop a tumble flow in the first hemisphere in a first direction and a tumble flow in the second hemisphere in a second direction with the second direction in an opposite sense with respect to the first direction.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 2:
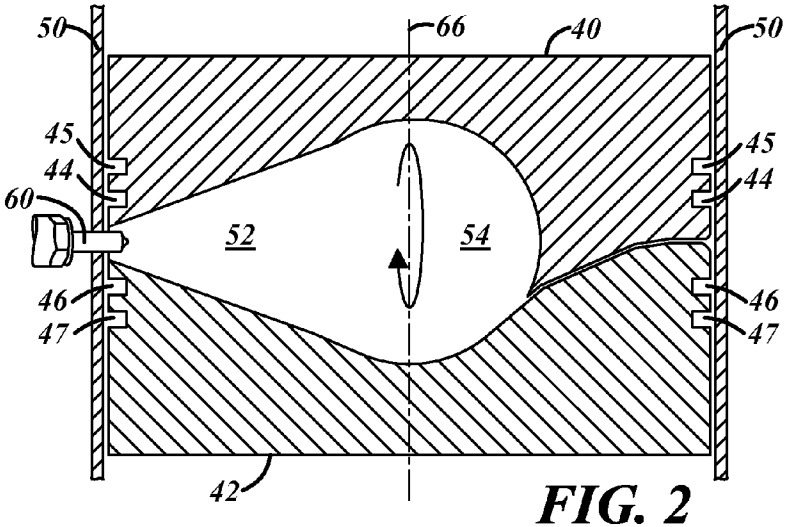

A cross section of a portion on an OPOC engine illustrating a combustion chamber according to an embodiment of the disclosure is shown in FIG. 2. A portion of intake piston 40 and a portion of exhaust piston 42 are shown at their closest position. Piston 40 has grooves 44 and 45 and piston 42 has grooves 46 and 47 to accommodate piston rings. For convenience in illustration, piston rings are not shown in the grooves in FIG. 2 nor in following figures illustrating pistons. Pistons 40 and 42 reciprocate within cylinder wall 50. The combustion chamber is the volume enclosed between the tops of pistons 40 and 42 and the cylinder wall 50. The tops of the pistons in their closest position are separated by at least 0.5 mm. Those skilled in the art appreciate that the minimum distance of separation varies depending on the particulars of the engine including size, tolerances, etc. Such range is provided as an example and not intended to be limiting.

In FIG. 2, a single-injector embodiment with an injector 60 is shown. The opening between pistons 40 and 42 in region 52 is substantially conical with a tip of the cone located proximate injector 60. The cross section of the opening increases to accommodate expanding fuel jets emanating from injector 60. Distal from injector 60 the opening between pistons 40 and 42, in region 54, is substantially a hemisphere. Fuel from injector 60 has momentum to travel through region 52 and potentially into region 54. However, much of the fuel has vaporized and the momentum of the liquid drops is reduced by shear with the compressed gases in the combustion chamber. Thus, if the injector hole size and fuel injection pressure characteristics are chosen carefully, few droplets impact the far wall of the combustion chamber from injector 60.

Figure 1:
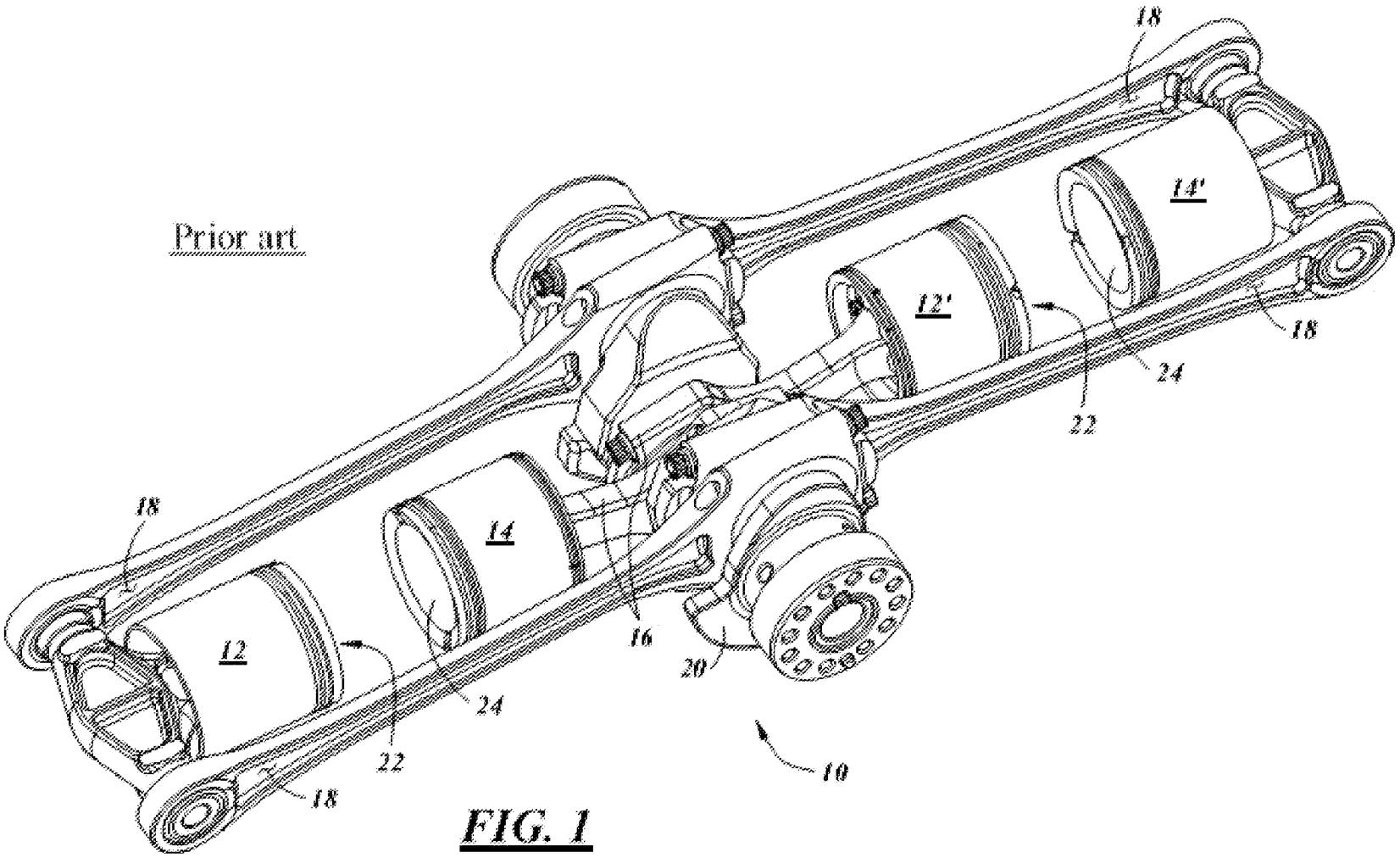
Prior art FIG. 1
FIG. 1 is an isometric drawing of an OPOC engine.
Figure 3:
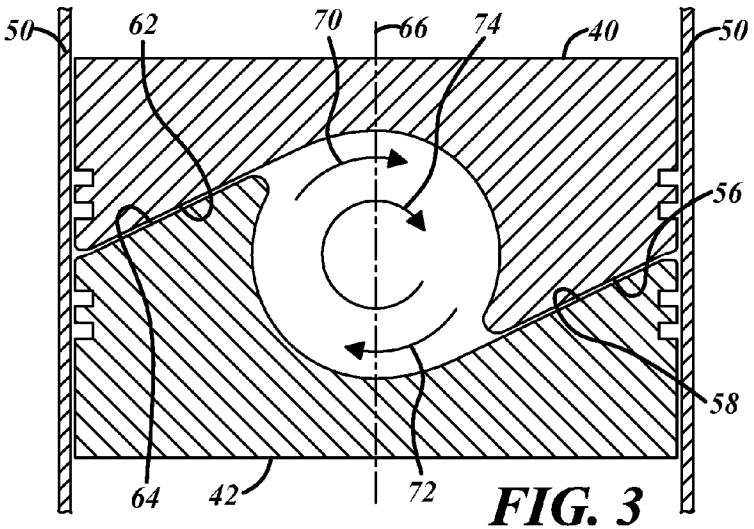
FIGS. 2-4 are cross-sectional views of a single-injector, tumble-inducing combustion chamber according to an embodiment of the present disclosure.

An alternative cross section, which is rotated 90 degrees from FIG. 2 is shown in FIG. 3, a view from the injector tip. The hemispherical shape of region 54 of FIG. 2 is more easily viewed in FIG. 3. The shape of the tops of pistons 40 and 42 promote tumble flow, i.e., a vortex with an axis of rotation substantially perpendicular with respect to the central axis of the central axis 66 of cylinder walls 50. A portion 64 of the top of piston 42 angles upward toward axis 66 and a portion 62 of piston 40 angles downward toward axis 66. As pistons 40 and 42 move toward each other, they force the gases between them to exit tangentially as illustrated by arrow 70. Similarly, portion 56 of the top of piston 40 and portion 58 of the top of piston 42, during a compression stroke, cause gases to exit tangentially as illustrated by arrow 72. The flows shown by arrows 70 and 72 interacting with the hemispherical region of the combustion chamber generate a tumble flow, as illustrated by arrow 74. Such tumble flow aids in mixing the fuel with the air to improve the combustion efficiency and reduce generation of diesel particulates.

The combustion chamber, per the view in FIG. 3, shows that the piston tops have an upward slope, as considered from left to right to facilitate generating tumble flow in the combustion chamber.

Figure 4:
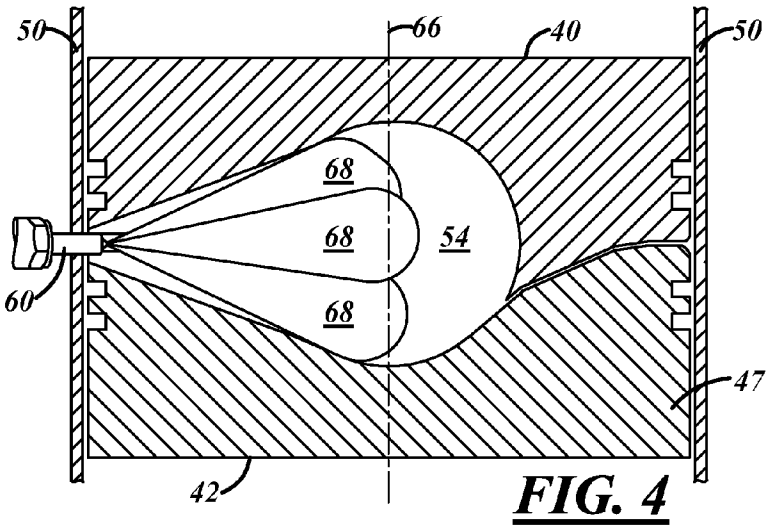

In FIG. 4, jets 68 exit from injector 60 into the combustion chamber. Tips of jets 68 have not reached region 54 at the time illustrated in FIG. 4. In FIG. 4, three jets are visible with additional jets possibly being occluded by the visible jets. However, any number of jets may exit injector 60.

Figure 5:
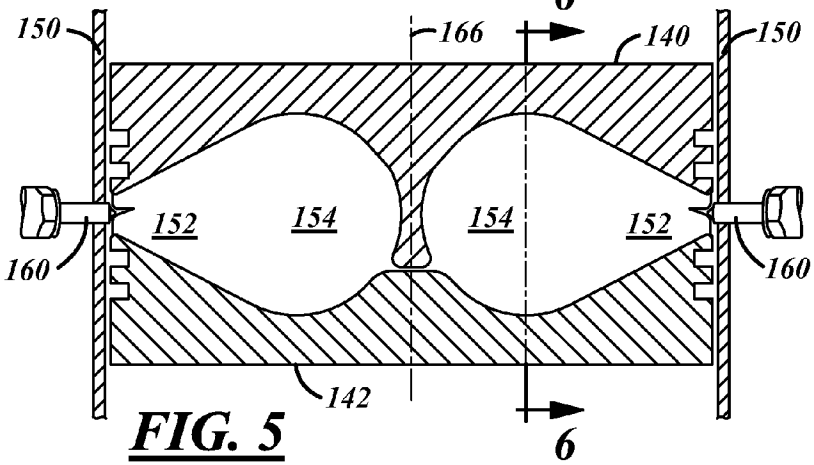
FIGS. 5 and 6 are cross-sectional views of a dual-injector, tumble-inducing combustion chamber according to an embodiment of the present disclosure in which two tumble flows rotating in substantially the same direction are induced.

It is desirable to have one injector supply fuel to the combustion chamber. However, if jets 68 from the one injector are unable to access the air in the cylinder to effectively utilize inducted air, a second injector may be provided in the cylinder. Such an embodiment with two injectors 160 in cylinder 150 is shown in FIG. 5. Two combustion chamber portions that are smaller versions of the combustion chamber of FIGS. 2 and 3 are provided in FIG. 5. Regions 152 of the combustion chamber that are proximate injectors 160 are substantially conical; regions 154 of the combustion chamber that are distal from injector 160 substantially form a hemisphere.

Figure 6:
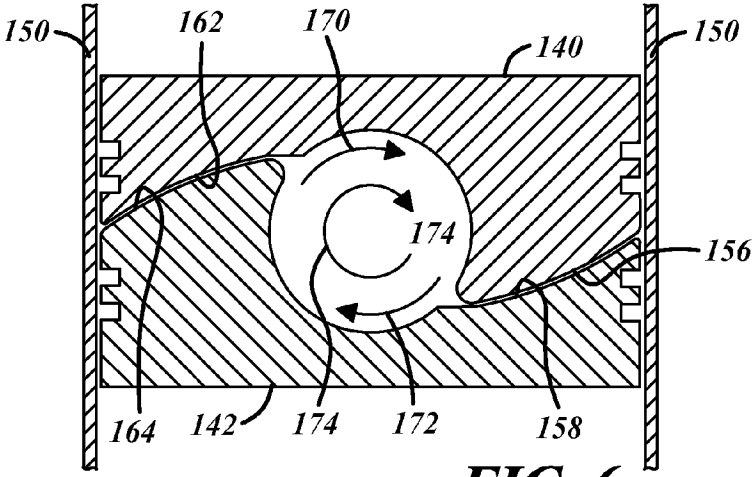

An alternative view of the pistons in FIG. 5 is shown in FIG. 6. The alternative view is rotated 90 degrees with respect to FIG. 5, i.e., a view as seen by a tip of one of injectors 160. A portion 162 of the surface of piston 142 and a portion 164 of piston 140 are angled upward to the right so that during a compression stroke, gases between portions 162 and 164 are squeezed as shown by arrow 170. Analogously, a portion 158 of piston 142 and a portion 156 of piston 140 slope upwards as taken from left to right so that gases between portions 156 and 158 are directed as shown by arrow 172. These flows, as illustrated by arrows 170 and 172, form a tumble flow as illustrated by circular arrow 174.

Figure 7:
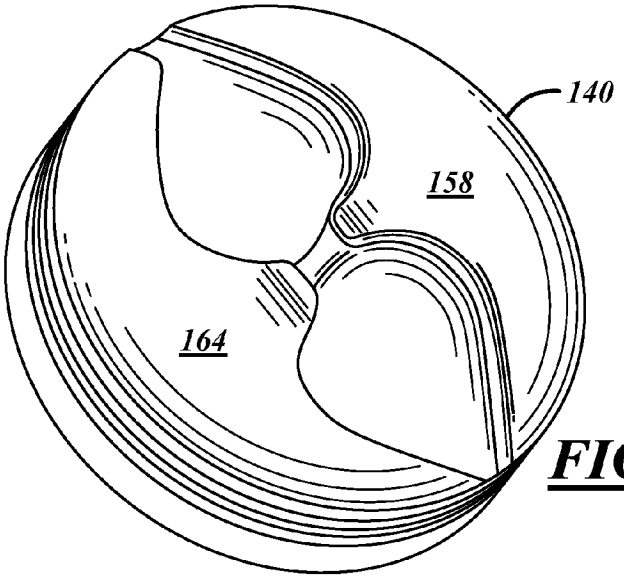
FIG. 7 is an isometric view of the top of the intake piston of FIGS. 5-6.
Figure 9:
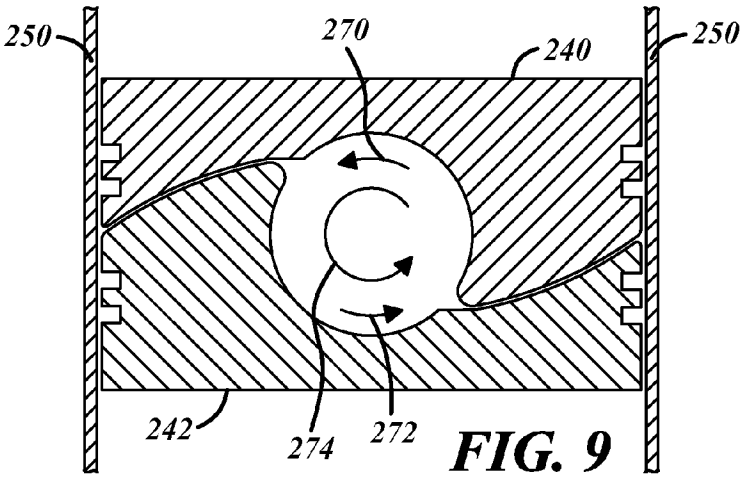
FIGS. 8 and 9 are cross-sectional views of a dual-injector, tumble-inducing combustion chamber according to an embodiment of the present disclosure with the tumble flows in the hemispherical counter rotating, i.e., in opposite directions.

The top of piston 140 is shown isometrically in FIG. 7 illustrating portions 158 and 164 in which the tumble in the two bowls rotates in the same general direction.

Figure 8:
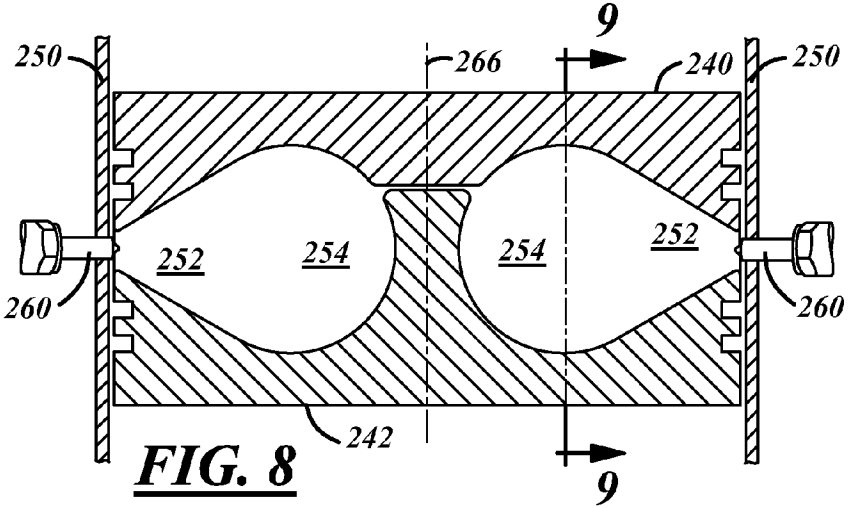

An alternative with counter-rotating tumble flows is shown in FIG. 8. Two injectors 260 are disposed in cylinder 250 and the volume between pistons 240 and 242 form two combustion chambers. Regions 252 of the combustion chamber that are proximate injectors 260 are substantially conical; regions 254 of the combustion chamber that are distal from injector 260 substantially form a hemisphere. Referring back to the embodiment in FIG. 5, the view of the combustion chamber shows that the primary portions of the combustion chamber surface is formed in intake piston 140. FIGS. 5-7 are different views of the same embodiment in which the tumble flows rotate in substantially the same direction. FIGS. 8-11 are views of an embodiment in which the tumble flows substantially counter-rotate. In the view of the combustion chamber illustrated in FIG. 8, in which the tumbles are counter rotating. The portion of the combustion chamber visible in FIG. 9 causes a tumble flow 274 from the jets of gases 270 and 272 that are squeezed out when pistons 240 and 242 move toward each other during a compression stroke.

Figure 11:
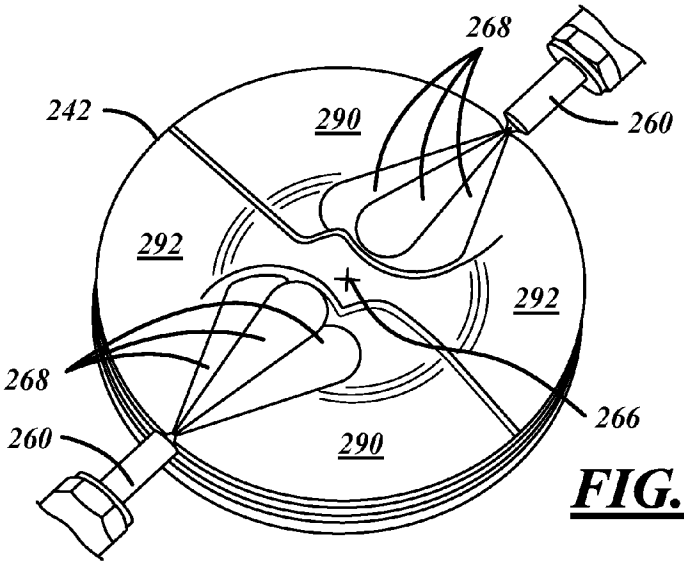
FIG. 11 is an isometric view of the top of the exhaust piston, respectively, of FIG. 10 with counter-rotating tumble flows.
Figure 10:
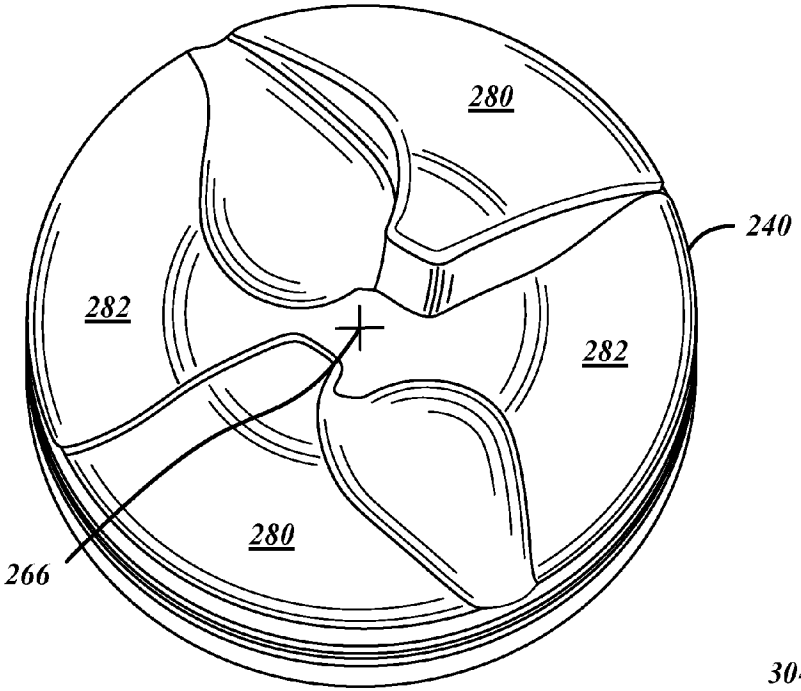
FIG. 10 is an isometric views of the top of the intake piston.

An isometric view of the top of piston 240 is shown in FIG. 10. Rather than the raised portion of the piston being on one side of the piston, as is the case in FIG. 7, raised portions 280 of piston 240 are opposite each other (across from each other with respect to axis 266), i.e., in quadrants across from each other with respect to central axis 266. Recessed portions 282 of the top of piston 240 are also arranged opposite each other. In FIG. 11, an isometric view of exhaust piston 242 is show with jets 268 spraying into the combustion chamber portions. Three jets 268 from each injector 260 are visible in FIG. 11. Additional jets may exit injector 260, but are not visible in FIG. 11. Alternatively, an injector with fewer or more jets may be used. Exhaust piston 242 has raised portions 290 diametrically opposed to each other and depressed portions 292 diametrically opposed to each other. Depressed portions 290 of exhaust piston 242 move toward raised portions 280 of intake piston 240 during reciprocation during operation. Depressed portions 282 of intake piston 240 move toward raised portions 292 of exhaust piston 242. Due to the depressed portions of each piston being adjacent a recessed portion, the direction of the tumble flow in the two combustion chamber portions are of opposite sense or counter-rotating.

Figure 12:
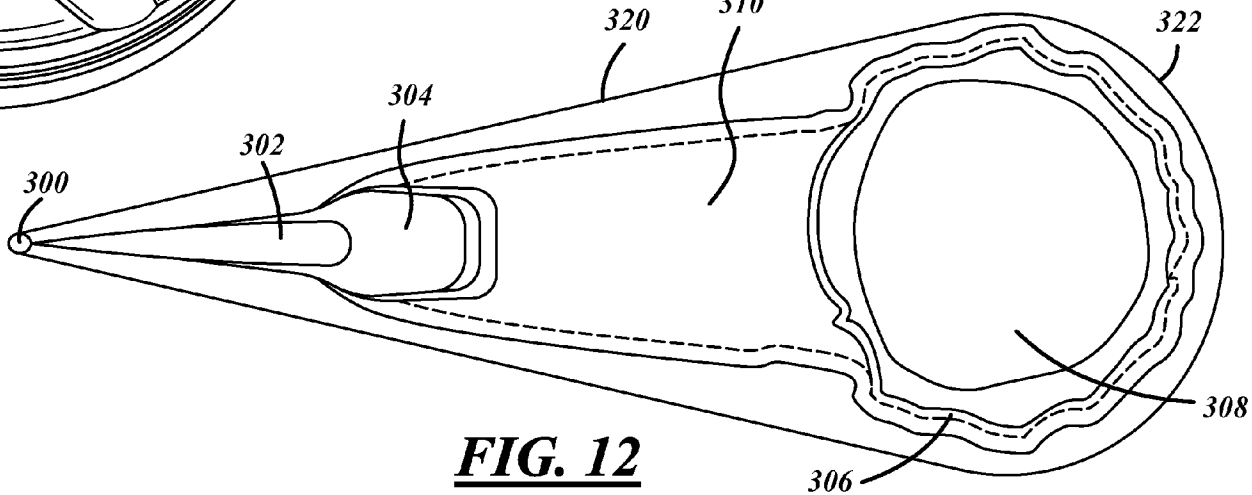
FIG. 12 is an illustration of fuel spray and combustion from a single fuel jet.

In FIG. 12, a representation of combustion of a diesel jet is shown. The fuel emanates from an orifice 300 of a fuel injector (not shown). The liquid drops travel through a region 302 with vaporization occurring. The fuel jets spreads in region 304 and due to vaporization of the fuel, a fuel rich zone develops in region 304. The jet continues forward and autoignition of premixed fuel and air ensues when fuel and air in a combustible mixture reach a temperature for a sufficient duration to autoignite. After the premixed fuel burns, a diffusion flame forms on the periphery of the jet in region 306. Soot forms within region 308, much of which is burned when the soot mixes with air. The fuel from the jet is contained substantially within a conical region 320 connected with a hemispherical region 322. The combustion chambers described herein are substantially conical with a hemisphere at the end, i.e., similar to the envelope which contains the fuel jet shown in FIG. 12.

Figure 14:
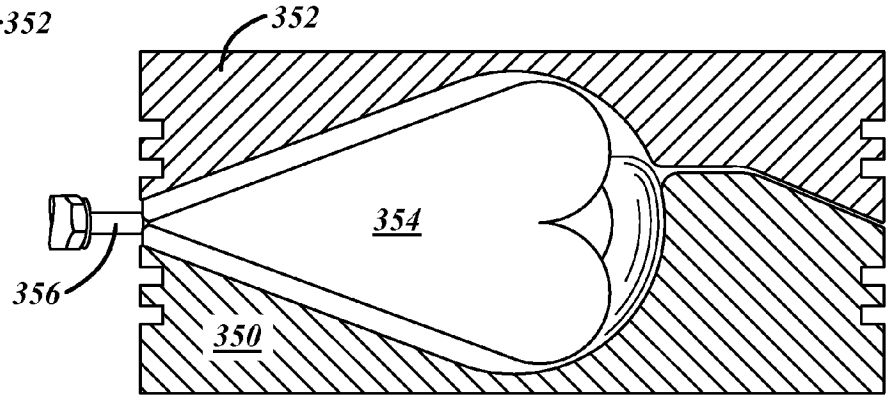
FIGS. 13 and 14 shown an alternative embodiment in which a single combustion bowl is offset from the center.
Figure 13:
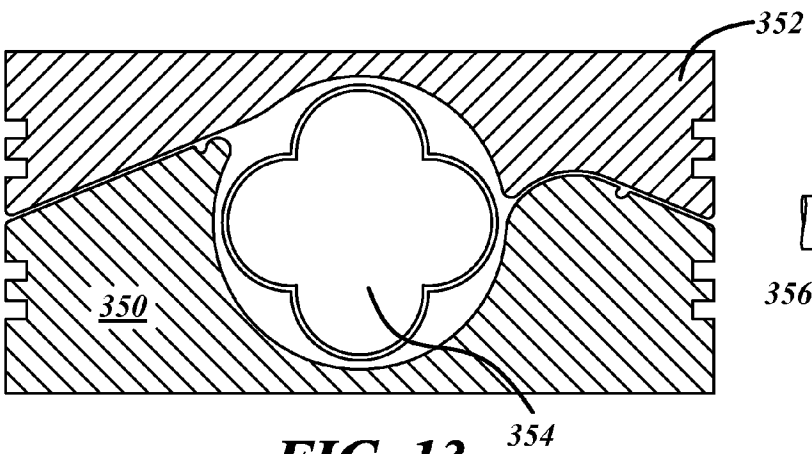

An embodiment in which the combustion chamber is defined preferentially in a piston 350 in FIGS. 13 and 14. In FIG. 13, it can be seen that piston 350 has a deep bowl while piston 352 has a shallower bowl. Also shown in FIG. 13 is an end view of fuel jets 354 from an injector (not shown). The example in FIG. 13 is a four jet injector at a location in which the jets have overlapped. FIG. 14 is a cross section taken at 90 degrees rotated from FIG. 13 in which the cross section is taken through injector 356.

Figure 15:
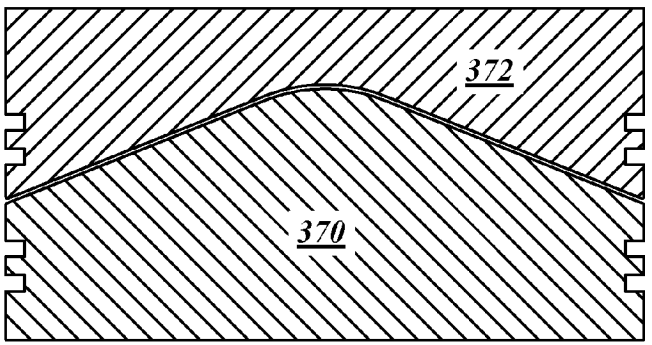

To aid in the description of the combustion chamber, a series of piston shapes leading up to the embodiment in FIGS. 13 and 14 are used. The intake and exhaust pistons, other than in the area of the combustion chamber, are substantially conical. Blanks of the pistons are shown in cross section in FIG. 15: piston 370 is conical (in a positive fashion) and piston 372 is negatively conical.

Figure 16:
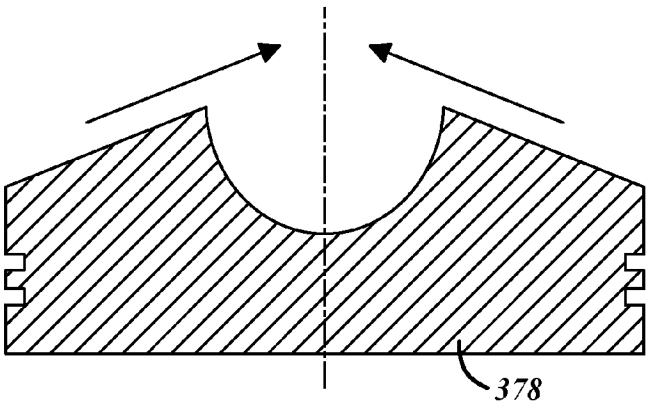
FIGS. 15-18 are illustrations to describe how to form piston tops according to an embodiment of the disclosure.

If the combustion chamber were to be taken out of the center from the exhaust piston as illustrated in FIG. 16, a tumble flow would not be generated. The squish flow on both sides is directed upwards as illustrated by the arrows. By displacing the combustion chamber toward one side, a feature can be added to cause the flow to tumble.

Figure 18:
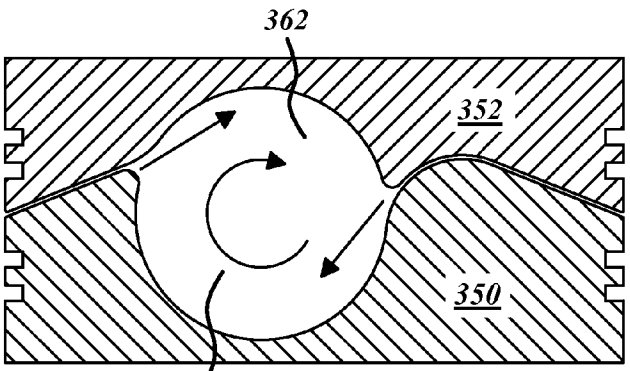
Figure 17:
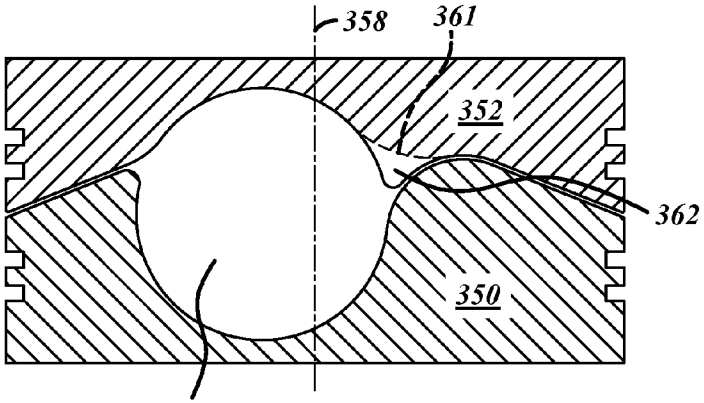

In the cross section shown in FIG. 17, the combustion bowl 360 is offset to the left of central axis 358 toward the left. On the left hand side of combustion bowl 360, the piston tops of both pistons slope upwards to the right. On the right hand side of combustion chamber, the interface between the two pistons also slope upwards to the right. However, this deviates from the purely conical shape, which is indicated by dashed line 361. A portion of the cone that would be in exhaust piston 350 is removed, i.e., the portion indicated by region 362. Region 362 is part of intake piston 352 (but would be part of exhaust piston if the conical shapes of FIG. 15 had remained). The benefit of this feature shown by region 362 is illustrated in FIG. 18. The squish flow generated from the interface between intake piston 352 and exhaust piston 350 when they approach each other on the left hand side of combustion bowl 360 causes an upward flow, similar to that shown in FIG. 16. An arrow is illustrating this upward flow in FIG. 18. On the right hand side of combustion bowl 360, a downward flow is generated when the pistons approach each other thereby causing a tumble flow in combustion bowl 17, as illustrated by the circular arrow.

Figure 19:
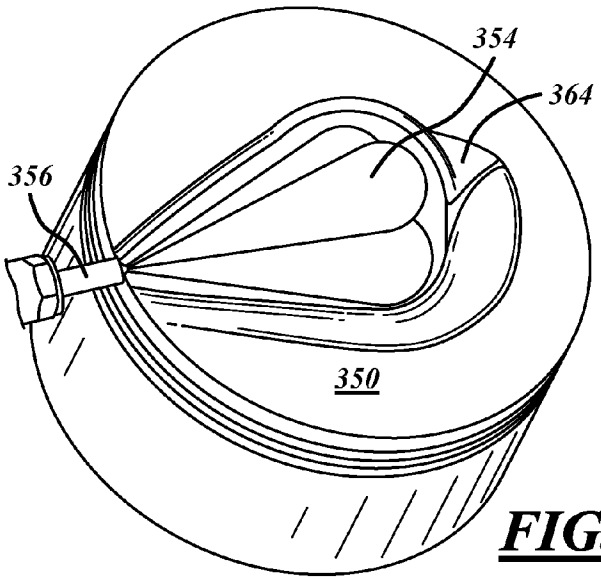

In FIG. 19, an isometric view of piston 350 is shown. As discussed above in regards to the cross-sectional view of piston 350 in FIG. 17, the shape of the piston on one side of combustion bowl 360 is different than on the other side. A transition region 364 is provided across from injector 356. In such a location, the transition region has little impact generating tumble flow as the desired geometry is provided along the majority of the fuel jet trajectory.

Figure 20:
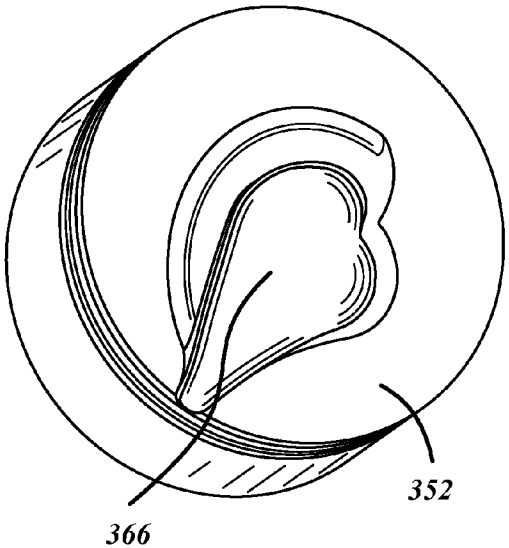

Piston 352 is shown isometrically in FIG. 20 and shows the offset nature of the combustion chamber and separately shows the combustion chamber. It is difficult to discern that piston 352 is concave from the two-dimensional drawing in FIG. 20. Nevertheless, as piston 352 is concave, it is known to one skilled in the art, that combustion bowl 356 is less deep than in embodiments in FIGS. 2-11. This may present an advantage in scavenging the combustion bowl region. However, the embodiments in FIGS. 2-11 are lighter and have fewer regions at which hot spots could form and thus may have some other advantages. The selection of the combustion chamber shape may depend on the ultimate application.

As discussed above, the 352 can be consider as starting out as a cone defined in the piston top, i.e, a negative cone. However, due to the desire to promote tumble flow, the region 361, as shown in FIG. 17, is built up. Thus, in some embodiments, the piston blank for piston 352 is not a negative cone, but has additional material formed in region 361. Region 361 has a fairly pointed tip extending downwardly toward exhaust piston 350. This forms a ridge in piston 352. It is advantageous that combustion bowl 360 is offset so that the ridge in region 361 is more nearly centrally located than it would be if combustion bowl 360 were centrally located. Thus, interference of the intake flow by the ridge of region 361 is minimized.

Figure 21:
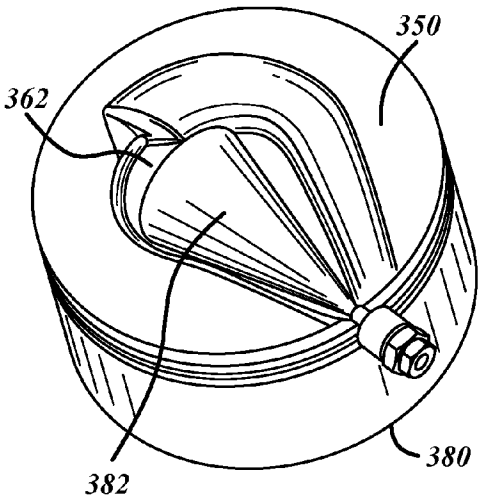
FIGS. 19-21 and 23 are isometric drawings of pistons according to several embodiments of the disclosure.
Figure 22:
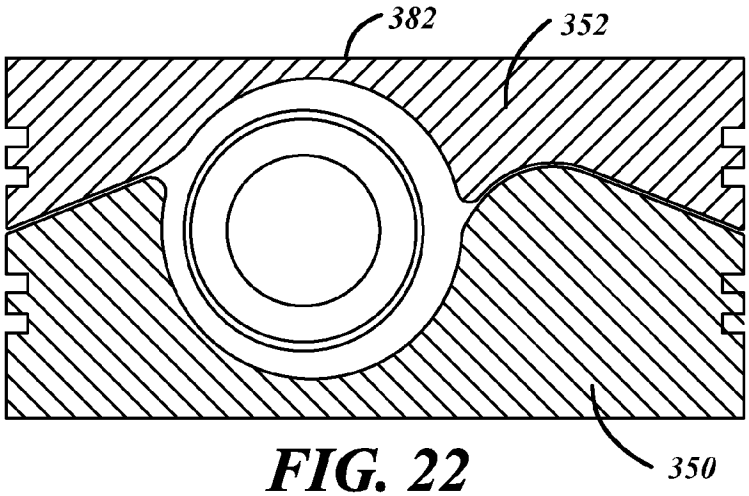
FIG. 22 is a cross-sectional view of the embodiment of FIG. 21.

In the above discussion, an injector with one or more orifices is discussed and shown in various figures. Alternatively, an injector with an outwardly opening pintle can be used. Such an injector provides a spray which is a hollow cone. The angle of the cone can be varied by varying the geometry of the injector tip. In FIG. 21, an isometric view of exhaust piston 350 is shown with a conical spray 382 is directed into combustion bowl 362. A cross section of the pistons and the conical spray is also illustrated in FIG. 22. Such a spray may benefit vaporization by allowing air to access the inner and outer surfaces of the conical spray. A pintle-type injector can be used in place of the multi-hole injector in any of the embodiments.

FIGS. 2-4 show a single-injector embodiment while FIGS. 5-7 show a dual-injector embodiment that is analogous to the embodiment of FIGS. 2-4. That is, the combustion bowls in FIGS. 5-7 are scaled down proportionally to accommodate two of the bowls shown in FIGS. 2-4. The embodiment of the single-injector embodiment shown in FIGS. 13-14 can be similarly extended to a dual-injector embodiment.

Figure 23:
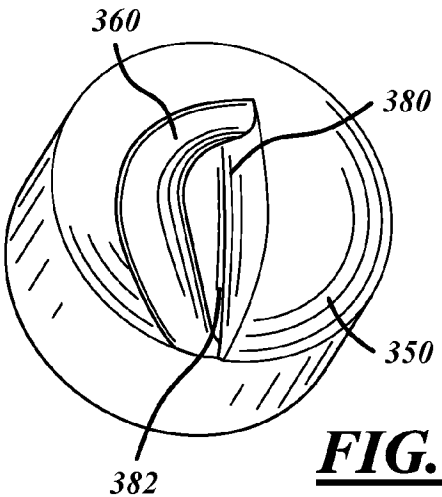

In FIG. 23 piston 350 is shown in an isometric view. The combustion bowl is comprised of a reentrant portion of a sphere 380 and a conical region 382 that provides a passage from an injector tip region 390 (injector not shown) to the portion of sphere 380. Material is removed from the blank piston in the region of 361. Referring back to FIG. 18, this provides the ability, in cooperation with piston 352, to direct the gases downward into combustion bowl 360.

Figure 24:
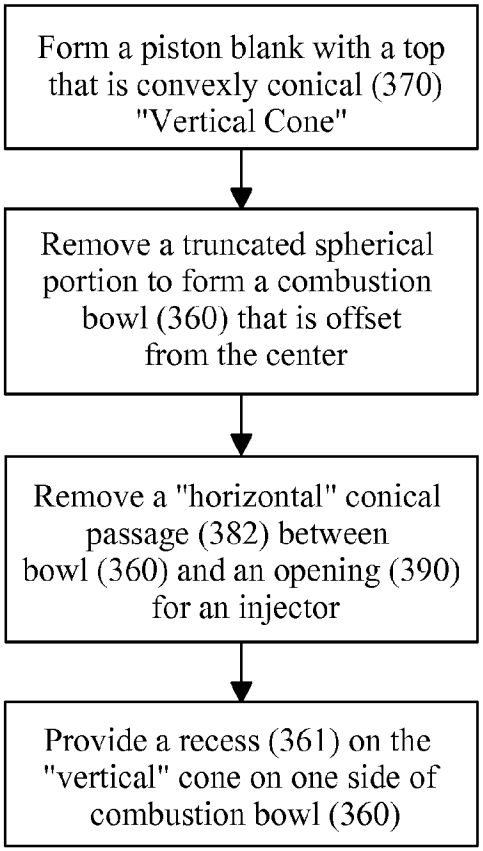
FIG. 24 is a method to make a piston according to an embodiment of the disclosure.

One method of making a piston is shown in FIG. 24. A piston is formed that has a top that is convexly conical 400. This is referred to a vertical cone for the purposes of discussion when viewing the piston with its central axis oriented vertically. The piston may be a unitary piston or be made of a plurality of elements. The portion including the piston top includes the cone. A spherical combustion bowl is formed in the cone and is offset from a central location 402. The portion of the combustion bowl formed in the exhaust piston is reentrant in the embodiment shown in FIG. 23. The sphere that is defined in the exhaust piston is a truncated sphere as a portion of the combustion bowl is also formed in the intake piston (not shown). A horizontally-arranged conical passage is defined in the piston top 404. The tip of the cone is arranged near the tip of the injector with the base of the cone coinciding with the sphere. The cone opens up to the combustion bowl to allow fuel jets, which are expanding after exiting the injector, to access the combustion bowl. A portion of the remaining cone is removed on one side of the combustion bowl to provide a recess. The recess in the exhaust piston with the corresponding built up area on the intake piston (as shown in FIG. 23) direct flow downwardly into the combustion bowl to promote tumble flow. Processes 402-204 in FIG. 24 can be performed in any order.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. An internal combustion engine, comprising:

a cylinder wall;

an intake piston disposed within the cylinder wall;

an exhaust piston disposed within the cylinder wall; and a first fuel injector disposed in an opening that pierces the cylinder wall;

a second fuel injector disposed in a second opening that pierces the cylinder wall, wherein:

the pistons are adapted to reciprocate within the cylinder walls;

the second fuel injector is in an opposed arrangement with respect to the first injector;

when tops of the pistons are at their closest approach, a volume between the pistons forms a combustion chamber with first, second, third, and fourth regions: the first region being substantially a first cone proximate the first injector with a tip of the first cone closer to the first injector and a base of the first cone away from the first injector; the second region being substantially a hemisphere with a flat surface of the hemisphere of the second region substantially coincident with a base of the first cone; the third region being substantially a second cone proximate the second injector with a tip of the second cone closer to the second injector and a base of the second cone away from the second injector; and the fourth region being substantially a hemisphere with a flat surface of the hemisphere of the fourth region coincident with a base of the second cone of the third region; and a cross section of the pistons coincident with the base of the cone of the first region shows the tops of the two pistons on each side of the hemisphere of the second region sloped so that thin ribbons that exist between the two piston tops when the pistons are at their closest approach are substantially tangent to a periphery of the hemisphere of the second region and a cross section of the pistons coincident with the base of the cone of the third region shows the top of the two pistons on each side of the hemisphere of the fourth region sloped so that thin ribbons that exist between the two pistons tops when the pistons are at their closest approach are substantially tangent to periphery of the hemisphere of the fourth region.

2. The engine of claim 1 wherein:

the first cone provides a line-of-sight opening between a tip of the first injector and the hemisphere of the second region;

the second cone provides a line-of-sight opening between a tip of the second injector and the hemisphere of the fourth region; and the second and fourth regions are substantially concave.

3. The engine of claim 1 wherein when the pistons approach each other, gases between the two pistons are squeezed into the conical and hemispherical regions inducing a vortex.

4. The engine of claim 3 wherein the vortex comprises tumble flow and an axis of rotation of tumble flow is substantially perpendicular to a central axis of the cylinder wall.

5. The engine of claim 1 wherein the hemisphere of the fourth region and the hemisphere of the second region do not overlap.

6. The engine of claim 1 wherein when the pistons approach each other, gases between the two pistons that are squeezed out into the hemispherical region of the second region generate a tumble flow in a first direction.

7. The engine of claim 6 wherein when the pistons approach each other, gases between the two pistons that are squeezed out into the hemispherical region of the fourth region generate a tumble flow substantially in the first direction.

8. The engine of claim 6 wherein when the pistons approach each other, gases between the two pistons that are squeezed out into the hemispherical region of the fourth region generate a tumble flow in a direction having an opposite sense as the first direction.

9. A combustion chamber for an internal combustion engine, comprising:

a cylinder wall;

an intake piston disposed within the cylinder wall;

an exhaust piston disposed within the cylinder wall; and first and second fuel injectors disposed in first and second openings that pierce the cylinder wall with the first and second injectors substantially opposed to each other wherein:

the pistons are adapted to reciprocate within the cylinder walls; and when tops of the pistons are at their closest approach, the combustion chamber which is a volume located between the tops of the piston and comprises: a first cone with a tip of the cone substantially coincident with a tip of the first injector and a base of the cone located away from the first injector; a second cone with a tip of the second cone coincident with a tip of the second injector and a base of the cone located away from the second injector; a first hemisphere with a base of the first hemisphere coincident with a base of the first cone; and a second hemisphere with a base of the second hemisphere coincident with a base of the second cone wherein;

considering first, second, third, and fourth quadrants of the piston tops, the intake piston has raised portions in the first and third quadrants, the intake piston has recessed portions in the second and fourth quadrants, the exhaust piston has recessed portions in the first and third quadrants, and the exhaust piston has raised portions in the second and fourth quadrants;

the raised and recessed portions are exclusive of the cones and hemispheres defined in the piston tops;

the second quadrant is located between the first and third quadrants; and the raised portions of the piston tops index with the recessed portions of the piston tops to develop a tumble flow in the first hemisphere in a first direction and a tumble flow in the second hemisphere in a second direction with the second direction in an opposite sense with respect to the first direction.

10. The combustion chamber of claim 9 wherein when tops of the pistons are at their closest approach, the first and second hemispheres are substantially isolated from each other.

11. The combustion chamber of claim 9 wherein when the pistons approach each other, gases between the tops of the pistons other than between the first and second cones and the first and second hemispheres are squeezed into the first and second cones and the first and second hemispheres; and the piston tops are arranged so that gases squeezed into the first and second hemispheres generate substantially tumbling flows.

12. The combustion chamber of claim 9 wherein the intake piston has a raised portion on one side of a plane intersecting tips of the first and second injectors and parallel to a central axis of the cylinder; the exhaust piston has a corresponding recessed portion on the one side of the plane; the intake piston has a recessed portion on the other side of the plane; and the exhaust piston has a corresponding raised portion on the other side of the plane.

13. The combustion chamber of claim 12 wherein the tumble flow in the first hemisphere rotates in substantially the same direction as the tumble flow in the second hemisphere.

14. The combustion chamber of claim 12 wherein the tumble flow in the first hemisphere rotates in substantially an opposite direction as the tumble flow in the second hemisphere.

15. A combustion chamber for an internal combustion engine, comprising:

a cylinder wall;

an intake piston disposed within the cylinder wall;

an exhaust piston disposed within the cylinder wall; and first and second fuel injectors disposed in first and second openings that pierce the cylinder wall with the first and second injectors substantially opposed to each other wherein:

the pistons are adapted to reciprocate within the cylinder walls; and when tops of the pistons are at their closest approach, the combustion chamber which is a volume located between the tops of the piston and comprises: a first cone with a tip of the cone substantially coincident with a tip of the first injector and a base of the first cone located away from the first injector; a second cone with a tip of the second cone coincident with a tip of the second injector and a base of the second cone located away from the second injector; a first hemisphere with a base of the first hemisphere coincident with a base of the first cone; and a second hemisphere with a base of the second hemisphere coincident with a base of the second cone wherein the intake piston is generally raised in two opposed quadrants of the top of the piston and generally recessed in the other two quadrants of the top of the piston and the exhaust piston is generally recessed in the quadrants associated with the raised quadrants of the intake piston and is generally raised in the quadrants associated with the recessed quadrants of the intake piston.

16. The combustion chamber of claim 15 wherein when tops of the pistons are at their closest approach, the first and second hemispheres are substantially isolated from each other.

* * * * *